US005362449A

United States Patent [19]

Hedenhag

[11] Patent Number: 5,362,449

[45] Date of Patent: Nov. 8, 1994

[54] REGENERATIVE GAS TREATMENT

[75] Inventor: Jorgen G. Hedenhag, Wayne, N.J.

[73] Assignee: Applied Regenerative Tech. Co., Inc., Morristown, N.J.

[21] Appl. No.: 38,138

[22] Filed: Mar. 26, 1993

Related U.S. Application Data

[63] Continuation-in-part of Ser. No. 661,498, Feb. 26, 1991, abandoned.

[51] Int. Cl.[5] ..... F28D 19/04; F23G 7/06

[52] U.S. Cl. ..... 422/175; 165/4; 165/7; 165/8; 165/9; 422/173; 422/182; 431/5; 432/180

[58] Field of Search ..... 422/182, 173, 175; 165/4, 7–9; 431/5; 432/180–182

[56] References Cited

U.S. PATENT DOCUMENTS

| | | | |
|---|---|---|---|
| 2,347,829 | 5/1944 | Karlsson et al. | 165/7 |
| 2,865,611 | 12/1958 | Bentele | 165/9 |
| 3,181,602 | 5/1965 | Johnstone | 165/5 X |
| 3,338,300 | 8/1967 | Turunen et al. | 165/5 |
| 3,404,965 | 10/1968 | Shiller | 422/175 X |
| 3,448,793 | 6/1969 | Wall, Jr. | 165/9 |
| 3,476,174 | 11/1969 | Guernsey et al. | 165/9 |
| 3,499,480 | 3/1970 | Theoclitus | 165/7 |
| 3,870,474 | 3/1975 | Houston | 23/277 |
| 4,174,748 | 11/1979 | Denjean | 165/9 |
| 5,016,547 | 5/1991 | Thomason | 110/211 |

FOREIGN PATENT DOCUMENTS

| | | | |
|---|---|---|---|
| 2373769 | 7/1978 | France | F28D 19/04 |
| 2065856 | 7/1981 | United Kingdom | F28D 19/00 |
| 1166209 | 10/1969 | U.S.S.R. | F23R 1/08 |

OTHER PUBLICATIONS

PCT-International Search Report PCT/US93/05453, Dec. 8, 1993.

*Primary Examiner*—Amalia L. Santiago
*Attorney, Agent, or Firm*—Thomas L. Adams

[57] ABSTRACT

A regenerative device can thermally treat gases. This device has a housing with a gas inlet and a gas outlet. A cage having a central interior is rotatably mounted in the housing between the inlet and the outlet. A plurality of gas permeable blocks are mounted peripherally in the cage around its central interior to provide therethrough: (a) an incoming flow path from the inlet to the central interior, and (b) an outgoing flow path from the central interior to the gas outlet. This incoming flow path within the blocks is non-converging. A drive motor can rotate the cage to move blocks successively past the inlet and the outlet.

42 Claims, 8 Drawing Sheets

REGENERATIVE GAS TREATMENT

This application is a continuation-in-part of a copending application, Ser. No. 07/661,498, filed Feb. 26, 1991 now abandoned, entitled Regenerative Thermal Oxidation System.

BACKGROUND OF THE INVENTION

1. Field of the Invention

The present invention relates to regenerative apparatus and regenerative methods for thermally treating gases, and in particular, to systems for circulating blocks in order to transfer heat.

2. Description of Related Art

Increasingly stringent environmental laws have required manufacturers and various businesses to reduce the amount of polluting or toxic emissions from various processes, especially emissions of volatile organic compounds ("V.O.C."). For example, waste solvent vapors, and various hydrocarbon fumes can be produced from printing processes, or from baking, or cooking. Some industrial processes produce such toxic emissions as benzene, formaldehyde, etc.

Such pollutants can be eliminated by heating them to the point where they decompose into non-toxic components such as water vapor or carbon dioxide. A disadvantage with such thermal decomposition is the relatively high cost of heating the pollutants. Thus a significant effort has been made to reduce the energy required for this thermal decomposition.

One known method for conserving energy is to use a heat exchanger to return the heat from the exhaust of a furnace to preheat air entering the furnace. Such preheaters have used heat exchangers of various types.

In U.S. Pat. No. 3,404,965 a drum is peripherally fitted with a number of porous ceramic blocks. The drum rotates around a horizontal axis between a gas inlet and outlet on opposite sides of the drum. A burner heats the inside of the drum to thermally decompose pollutants delivered to the inside of the drum. The thermally cleansed gas exits through the porous ceramic blocks and heats them. The heated blocks circulate to an upstream position so that the incoming gas stream is preheated by passing through the heated ceramic blocks.

One disadvantage with U.S. Pat. No. 3,404,965 is that the porous ceramic blocks present to the incoming gas stream a converging cross section. Thus incoming gas would accelerate if kept within the blocks. This undesirably reduces the residence time in the porous blocks. Moreover, the sides of the block are open so that incoming gas will either be driven to accelerate or take the path of least resistance and leak through the sides of the converging block.

Also, the structure of U.S. Pat. No. 3,404,965 is arranged to inject and withdraw gas only over about half the circumference of the drum. This inability to use a greater number of the porous blocks decreases efficiency.

Also, this drum is completely enclosed in the hot interior of a casing lacking effective seals. For this reason, the casing enclosing the drum and the moving parts is double walled and insulated. Consequently, the moving parts inside the casing tend to be overheated. Also, incoming gas can escape to the casing surrounding the drum to eventually bypass the porous ceramic blocks.

In U.S. Pat. No. 3,718,440 a ceramic disc having a number of triangular passages rotates past the inlet and outlet of a combustion chamber to return exhaust heat to the incoming gas stream. Various moving parts and bearings associated with the rotating disc are mounted for exposure to the cooler incoming gas flow to avoid overheating. The seals around the rotating disc, however, are necessarily exposed to relatively hot gas and special precautions are made to avoid overheating. Since this system uses a flat disc, little mass is available for transferring heat from outlet to inlet.

See also U.S. Pat. Nos. 2,121,733; 3,167,400; 3,172,251; 3,211,534; 3,634,026; 3,870,474; 3,895,918; 3,997,294; 4,302,426; 4,474,118; 4,650,414; 4,678,634; 4,793,974.

Accordingly, there is a need for an enhanced regenerative gas treatment system that has enhanced efficiency, utilizes its gas permeable blocks more effectively; and keeps the heated areas confined so that moving parts are not unnecessarily exposed to high temperatures.

SUMMARY OF THE INVENTION

In accordance with the illustrative embodiments demonstrating features and advantages of the present invention, there is provided a regenerative device for thermally treating gases. The device has a housing with a gas inlet and a gas outlet. A cage having a central interior is rotatably mounted in the housing between the inlet and the outlet. A plurality of gas permeable blocks are mounted peripherally in the cage around the central interior to provide therethrough: (a) an incoming flow path from the inlet to the central interior, and (b) an outgoing flow path from the central interior to the gas outlet. This incoming flow path within the blocks is non-converging. The device also has a drive means for rotating the cage to move the blocks successively past the inlet and the outlet.

Alternate regenerative devices according to the principles of the same invention can also thermally treat gases. As before, a cage with a central interior is rotatably mounted in a housing between an inlet and outlet. Again, a plurality of gas permeable blocks are mounted peripherally in the cage around the central interior to provide therethrough: (a) an incoming flow path from the inlet to the central interior, and (b) an outgoing flow path from the central interior to the gas outlet. A pair of air seals is mounted on opposite sides of the housing, each between the gas inlet and the gas outlet. The air seals peripherally adjoin the cage and deliver air at a pressure higher than that inside the housing. This device also includes a drive means for rotating the cage to move the blocks successively past the inlet and the outlet.

A regenerative method according to the principles of the same invention can thermally treat gases with a plurality of gas permeable blocks arranged to encircle a central interior. The method includes the step of circulating the blocks around an upstream position and a downstream position. Another step is admitting the gases through the blocks at a spatially fixed, upstream location into the central interior without converging the gases flowing through the blocks. The method also includes the step of discharging gas from the central interior through the blocks at a spatially fixed, downstream location.

Another regenerative method, according to the principles of the same invention can thermally treat gases, again with a plurality of gas permeable blocks arranged to encircle a central interior. The method includes as before, circulating the blocks around an upstream position and a downstream position. Another step is admitting the gases through the blocks at a spatially fixed, upstream location into the central interior. The method further includes the step of discharging gas from the central interior through the blocks at a spatially fixed, downstream location. The method also includes the step of diverting external air to opposite sides of the housing between the upstream position and the downstream position to peripherally impinge on the blocks at a pressure higher than that around the blocks.

Apparatus and methods of the foregoing type achieve a highly effective regenerative thermal treatment of gases. The present invention may take the form of a regenerative thermal oxidation device, a major purpose of which is conservation of fuel. The present invention further addresses the control of volatile organic compounds, odor control and fume control.

Accordingly, the preferred embodiment of the present invention is an apparatus which is lightweight, compact and valveless for both commercial and industrial treatment of gases, including for example, gases from fast food grill exhausts (with volumes of about 2000 SCFM); wide ranges of V.O.C.'s from printing and laminating may be disposed of with a high percentage of thermal energy recovery; emissions from painting and spray booths may be effectively disposed of at high rates of energy recovery; hydrocarbons from air strippers may be disposed of at high rates of thermal energy recovery, gases from solid waste destruction may be disposed of; gases from municipal waste treatment may be disposed of; and emissions from various chemical manufacturing processes may be disposed of, again at high rates of thermal energy recovery. Automotive exhaust emissions as well as many other prospects of treatment are contemplated in accordance with the present invention.

The apparatus herein disclosed can be fabricated, constructed and shipped in an efficient and compact mechanism. This mechanism can be substantially lighter in weight than other regenerative units. The preferred apparatus eliminates the use of flow control valves, and their associated leakage and operational problems.

In a preferred embodiment a cage is mounted in a housing to rotate atop a number of rollers. The cage is driven by a ring gear on a lower edge of the cage. Preferably, a burner is mounted over the cage to heat the cage interior.

This preferred embodiment has a plurality of rectangular blocks with a multiplicity of narrow passages. These ceramic blocks circulate past a gas inlet and gas outlet to exchange heat from the gas outlet to the gas inlet. The preferred blocks do not converge to restrict the gas flowing from the gas inlet. Thus incoming gas does not accelerate to decrease the residence time within the ceramic blocks. The preferred gas inlets and gas outlets together cover almost all the periphery of the ceramic blocks in the cage. Thus almost all of the ceramic blocks are in the process of either absorbing or delivering heat, thereby enhancing efficiency.

In the preferred embodiment a housing encircles the cage but does not enclose the moving parts and the parts supporting the cage. Thus these parts are not subjected to the high temperatures within the cage.

The preferred embodiment also has an air seal that divides the periphery of the cage into an inlet and an outlet side. If the inlet and outlet are considered to be at the twelve o'clock and six o'clock positions, the preferred air seals are at the three o'clock and nine o'clock positions. The air seals provide a positive air flow that divides into an upstream and downstream branch to isolate the inlet and outlet sides. Because of this positive pressure, gas on the inlet side has no opportunity to pass to the outlet side and vice versa. By avoiding leakage bypassing the cage, efficiency is greatly enhanced.

In addition, the preferred embodiment has a separate heater located adjacent to one of the air seals to bake off contaminants that have deposited on the ceramic blocks. The deposits are decomposed into water vapor and carbon dioxide thereby cleaning the passages in the ceramic blocks so they can operate efficiently.

BRIEF DESCRIPTION OF THE DRAWINGS

The above brief description as well as other objects, features and advantages of the present invention will be more fully appreciated by reference to the following detailed description of presently preferred, but nonetheless illustrative embodiments, in accordance with the present invention when taken in conjunction with the accompanying drawings, wherein.

DETAILED DESCRIPTION OF THE PREFERRED EMBODIMENTS

Figure 1:
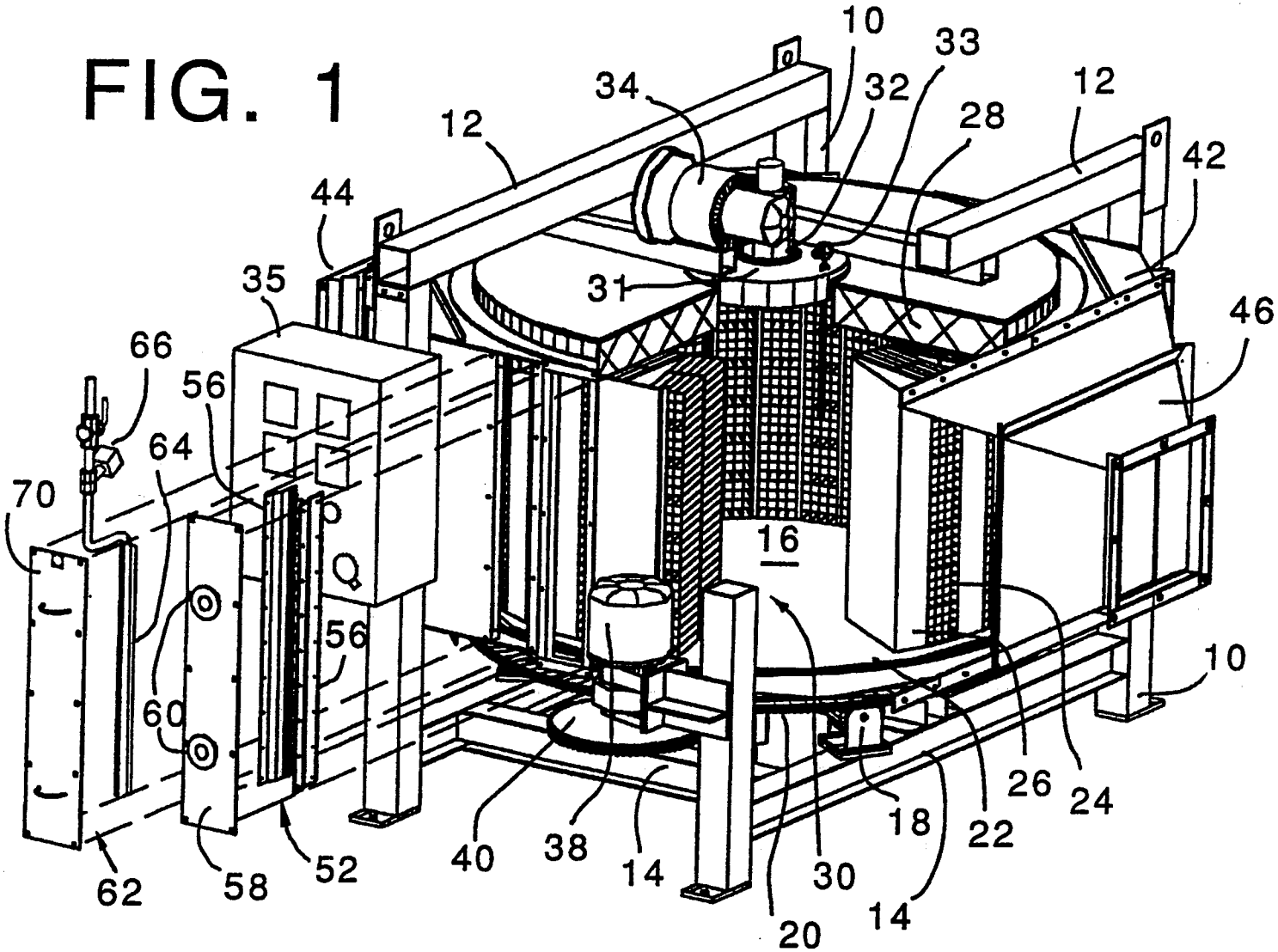
FIG. 1 is an axonometric view of a regenerative device, in accordance with principles of the present invention, with portions cut away and portions partially exploded for illustrative purposes, wherein a continuous flow is maintained without the use of flow control valves.
Figure 2:
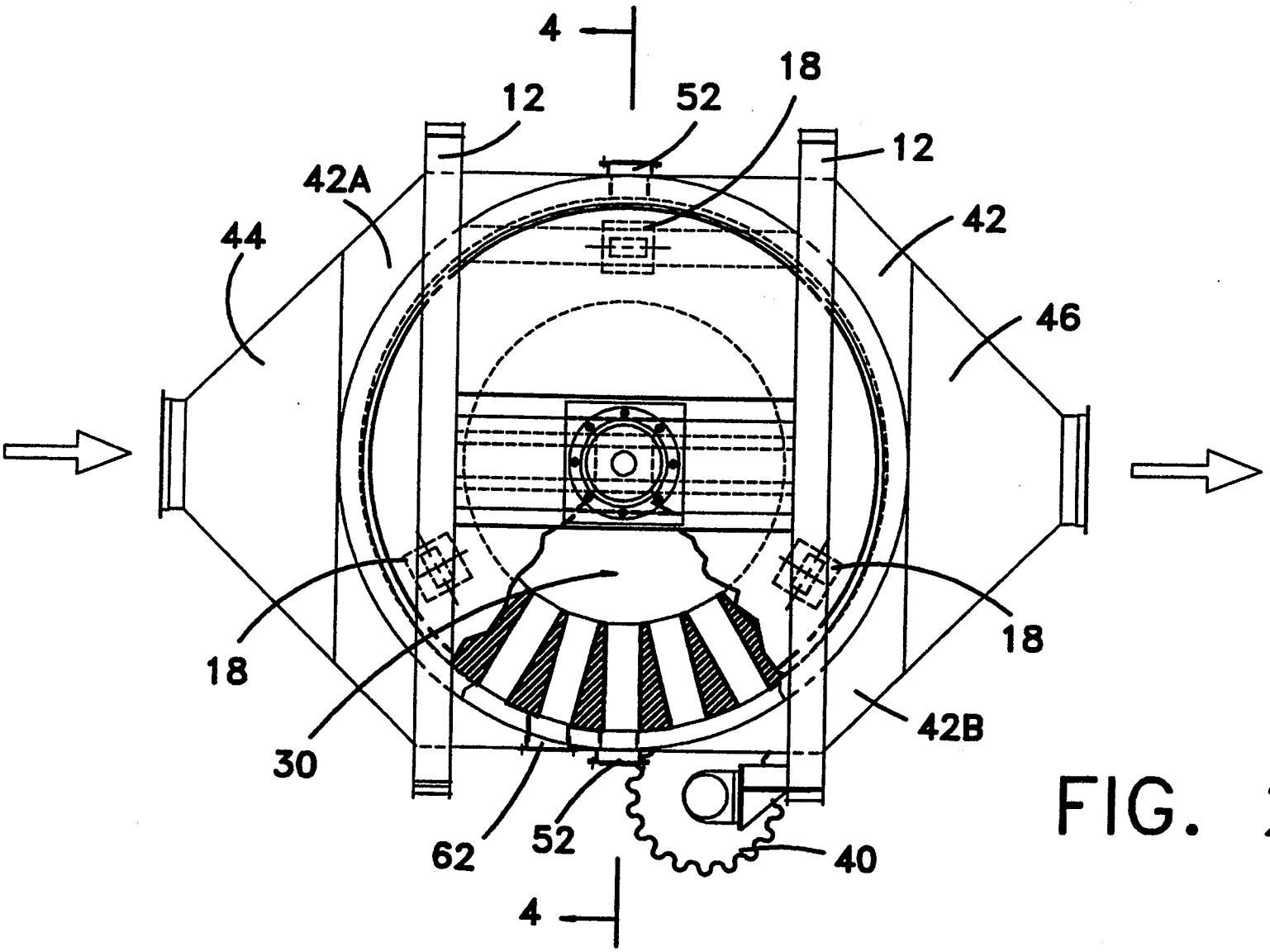
FIG. 2 is a top view of the device of FIG. 1.
Figure 3:
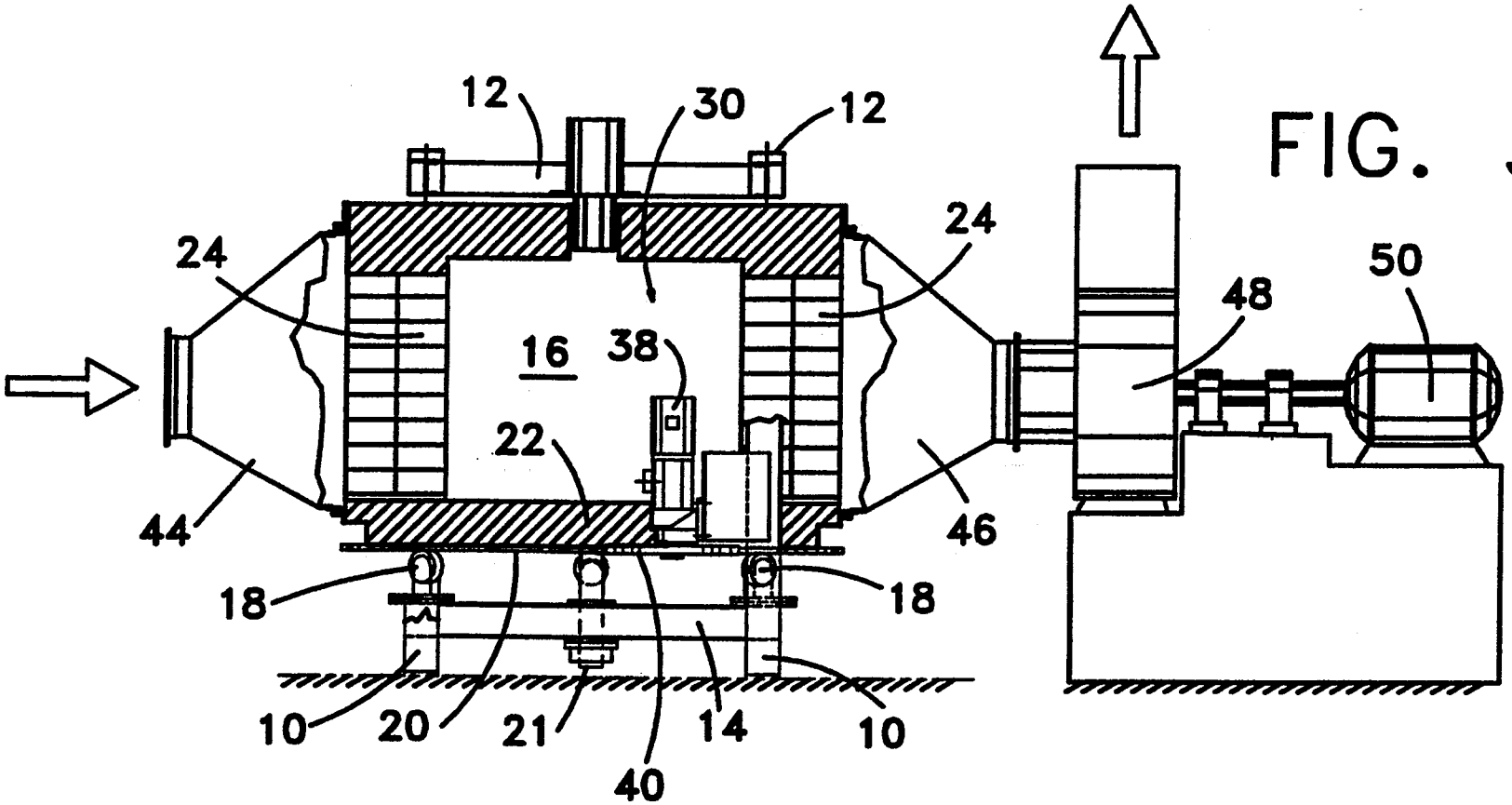
FIG. 3 is a side view of the device of FIG. 1 shown connected to a downstream blower.

Referring to FIGS. 1-3 a regenerative device is mounted on four upright support beams 10, which support upper cross beams 12 and lower cross beams 14. The supporting frame apparatus 10, 12, 14 can be in a variety of forms and modes, formats or arrangements. The entire beam arrangement 10, 12, 14 is then supported on a floor, ground, frame or the like.

A cage 16 is rotatably mounted on beams 14. Cage 16 is shown as having a plurality both of upstanding rectangular ceramic or metallic heat exchange media passages 24 and intermediate polygonal insulation sections 26, which form the walls of cage 16. It will be understood that there can be any number of heat exchange passages. The heat exchange media 24 forming a heat exchange passage provides suitable gas permeable channels or any suitable means such as will allow for gas flow communication into and out of combustion chamber 30.

Cage 16 is supported by a trio of equiangularly spaced rollers 18 mounted on cross beams 14. Rollers 18 underlie the periphery of support plate 20 whose edge is formed into a ring gear. Mounted atop support plate 20 is an insulating layer 22 forming a floor that may be lined with a heat resistant liner, such as ceramic board and preferably constructed of refractory or ceramic material or the like, similar to the polygonal insulation sections 26. While ceramic board is disclosed, various other refractory materials can be used instead. Plate 20 and layer 22 have a circular border. Support plate 20 can be journaled on a central axle 21 that is mounted to the cross beams 14. Axle 21 keeps support plate 20 and the cage 16 centered on the rollers 18.

Mounted atop insulated base 22 are twenty four groups of equiangularly spaced, gas permeable blocks 24. In this embodiment, blocks 24 are stacked in a 4×4 arrangement, seven blocks high, although a different number of variously shaped blocks (including a solid monolith) arranged in different patterns are possible instead.

In this embodiment, each of the blocks 24 were rectangular ceramic solids 9" (22.8 cm) long with a 6" (15.2 cm) square end. This ceramic can be formed into a honeycombed structure having a multiplicity of square passages or cells running the full length of the block. The cells can have density of 25 to 400 cells per inch$^2$ and one constructed embodiment employed 300 cells per inch$^2$. This structure can be relatively open with 40% to 70% of the surface area exposed to passages. In various alternate embodiments, the cell density and the shape and mass of the block can be varied depending upon the amount of heat energy to be stored in the block, the heat transfer rate, the mass flow rate, as well as the passage size needed in view of the expected particle size. The ceramic material can be alumina, but various other kinds of ceramics and other materials are possible. Gas permeable ceramics of this type can be purchased form Corning as honeycomb supports, under the trademark, CELCOR.

In some embodiments, gas permeable blocks 24 may be made of a ceramic foam. Such ceramic foam can be obtained from Consolidated Aluminum, of Hendersonville, N.C., as SELEE brand open porous ceramic foam. In still other embodiments, a steel honeycomb can be made from corrugated sheet metal sandwiched between metal plates to provide a heat absorbing metallic body with high surface area.

Insulating blocks 26 are interleaved with the gas permeable blocks 24. Insulating blocks 26 may be wedged-shaped monoliths sawed from a ceramic blanket. It will be appreciated that non-monolithic and other types of insulators can be used instead. Preferably, insulating blocks 26 are impervious to the gases handled by the system. The cylindrical space within the blocks 24 and insulators 26 is referred to herein as a combustion chamber or central interior 30.

Mounted atop blocks 24 and insulators 26 is an annular insulating ceiling 28. The internal construction of the ceiling 28 has a heat resistant liner, preferably constructed of refractory or ceramic material or the like, similar the polygonal insulation sections 26. The ceiling 28 is preferably sawed from ceramic board and clad on top by steel plate. The steel top of ceiling 28 can also have a ring gear around its periphery to facilitate a gear drive. The center of the ceiling 28 contains an opening to facilitate the installation of a burner or other heating element described hereinafter.

Mounted atop cross beams 12 is a heater means, shown herein as a burner 32 for injecting a flame down into the center of central interior 30. Burner 32 cooperates with a forced air blower 34. Natural gas is supplied as a fuel, although the burner may consume other fuels such as propane, waste solvents, No. 2 heating fuel, etc. In some embodiments the gas being treated inside cage 16 may be so exothermic that additional heat need not be added through burner 32. Burner 32 has a nozzle that is concentrically mounted through a fixed annular insulating plug 31.

In the preferred embodiment, burner 32 is thermostatically regulated by a thermocouple 33 to keep the temperature within the central interior 30 in the vicinity of 1500° to 2000° F., although other temperatures are contemplated for decomposing various types of contaminants. Accordingly, interior 30 functions as a combustion chamber for heating incoming gases up to temperatures of 2000° F. or more, by means of one or more burners 32 of the oil or gas operated type therein, or with an electrical heating element.

Cage 16 is rotated about axle 21 by a drive means 38, shown herein as a variable speed, electric motor with a gear reducer for driving pinion 40, which engages ring gear 20. Motor 38 is arranged to turn cage 16 at a preferred speed of 6 revolutions per minute or less. The speed of motor 38 will vary the period of the regenerative cycle and thereby establish the effective thermal efficiency of the unit.

Figure 8:
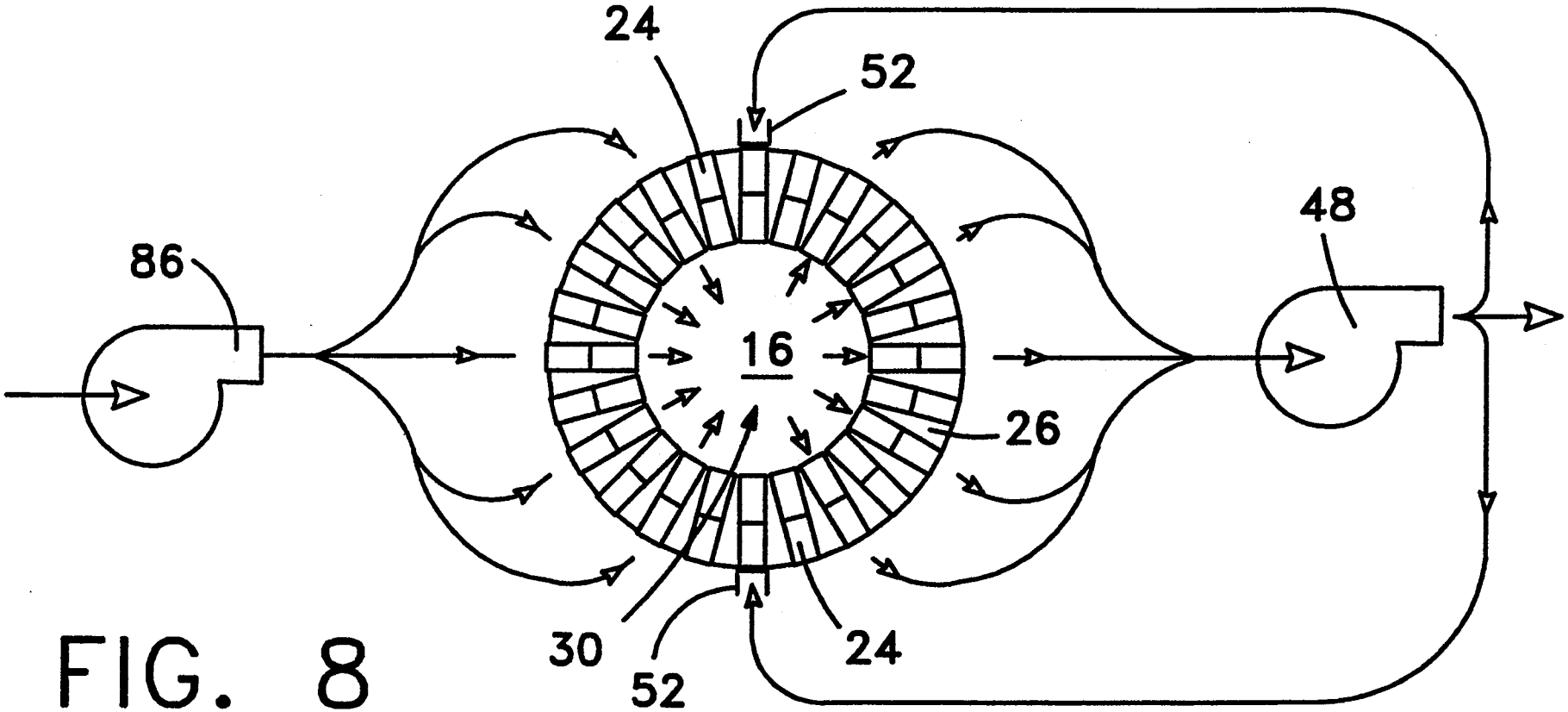
FIG. 8 is a schematic diagram showing a method of circulating gases around the device of FIG. 1.

A housing 42 encircles cage 16. Housing 42 has an eight-sided ceiling and floor with a circular opening occupied by cage 16. Housing 42 has two opposite, parallel walls that span between diverging walls 42A and converging walls 42B. Walls 42A connect to a pyramidically shaped duct 44, herein referred to as a gas inlet. Similarly, walls 42B connect to a pyramidically shaped duct 46, herein referred to as a gas outlet. Ducts 44 and 46 will evenly distribute gases around the cage 16 to radially pass through their heat exchange passages. Gas outlet 46 connect to a blower 48 driven by electric motor 50 to induce a draft through cage 16 as seen in FIG. 8.

The housing 42 is shown mounted on the upper side of cross beams 14. Preferably, but not necessarily, all of the housing 42 is constructed of steel with internal or external insulation as required.

The device of FIGS. 1–3 is about 8 feet (2.44 meters) tall and is designed to operate in the range of 5,000–7,000 SCFM, although clearly the device can be sized differently to operate at different capacities. The various steel plates forming housing 42, cage 16 and ducts 44 and 46 are typically made of 3/16" (0.47 cm) steel plate, although other materials and dimensions are possible.

Leakage between the inlet 44 and outlet 46 is prevented by a pair of air seals 52. Air seals 52 effectively provide air pressure nozzles around the internal periphery of the housing 42 next to cage 16. One of the air seals 52 is shown for mounting in an opening 54 (FIG. 1) in the side of housing 42. Air seal 52 forms a duct with two parallel duct walls 56 covered by a faceplate 58 having several inlet holes 60.

Clean air from outlet 46 or the like is supplied back to the air seal 52 to pressurize the slot opening 54 adjacent the rotating cage 16, thus preventing any cross contamination between the dirty process gases in the inlet 44 and the clean exhaust in the outlet 46. Similarly, air can be exhausted from the air seal 52 and reintroduced to the inlet 44 or directly into the combustion chamber 30, thus preventing any cross contamination between the dirty process gases in the inlet 44 and the clean exhaust in the outlet 46.

Because blower 48 can induce a draft or negative pressure within cage 16, in some embodiments ambient air will flow by itself into inlets 60 of air seal 52. The air will enter opening 54 and divide into an upstream and downstream branch. This dividing air flow prevents leakage of gas around the outside of cage 16 from inlet 44 to the outlet 46 or vice versa.

Figures 6, 7:
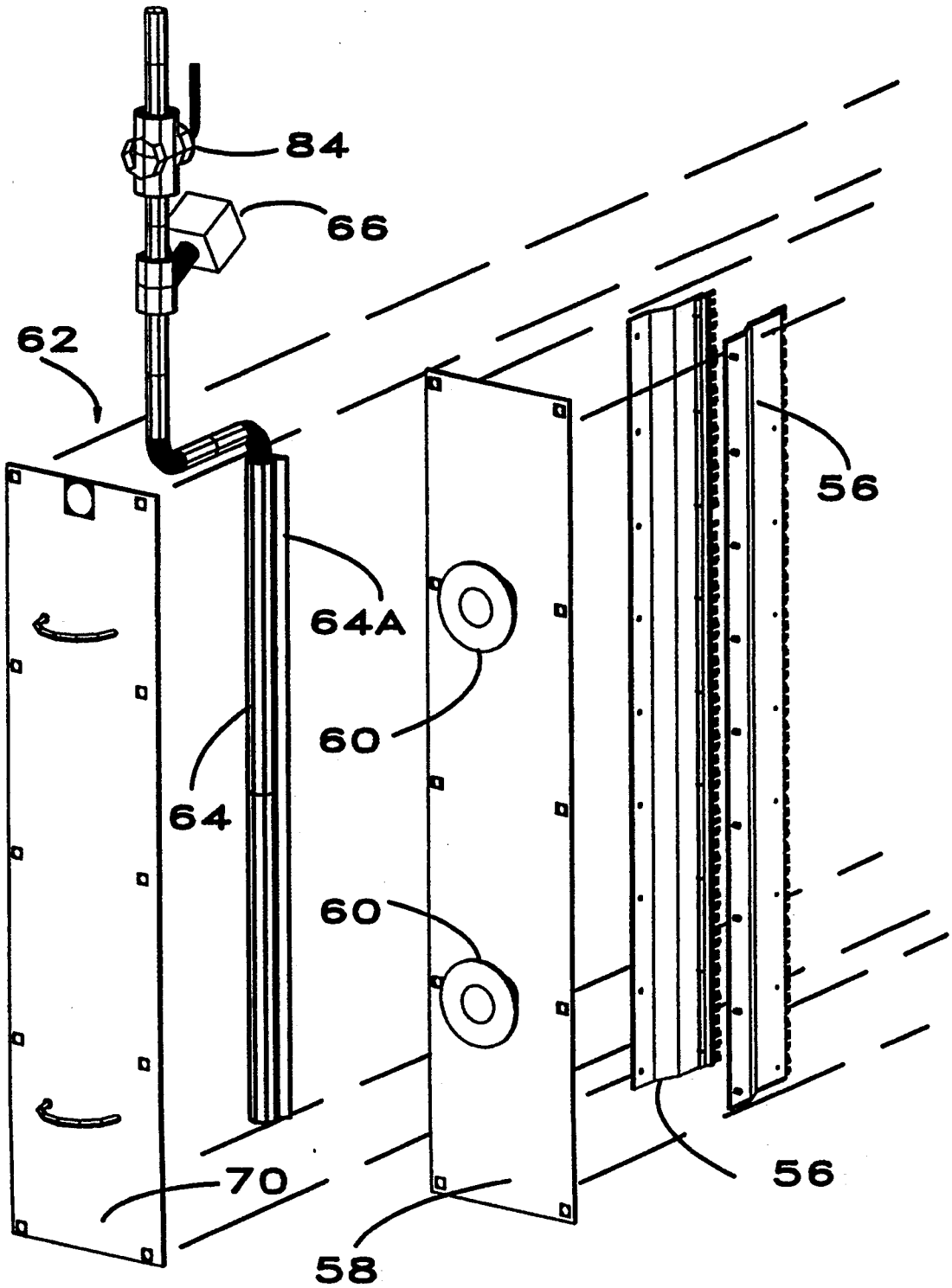
FIG. 6 is an detailed, exploded, axonometric view of the air seal of FIG. 1.
FIG. 7 is a detailed, exploded, axonometric view of the optional thermal means of FIG. 1 for eliminating organic particulate and condensable buildup on the heat exchange media.

A thermal means 62 is shown in FIG. 7 as an auxiliary high temperature burner tube 64 fed by a regulator valve 66 and designed to be mounted inside the opening 68 in housing 42. Once tube 64 is in place, opening 68 is covered by a faceplate 70. Burner tube 64 can be supplied with the same fuel as burner 32, although other energy sources can be used as well. Burner tube 64 can raise the temperature of ceramic blocks 24 to bake off residual organic particulate, aerosols, or condensables that condense in blocks 24. Burner tube 64 is designed to provide heat sufficient to decompose these deposits into such harmless constituents as water vapor or carbon dioxide.

The thermal means 62 can be placed at different angular positions for baking and decomposing deposits on the gas permeable blocks 24. In some embodiments this thermal device can extend over a larger angular interval or may be segregated into a number of spaced burners that operating at different heights.

Figure 5:
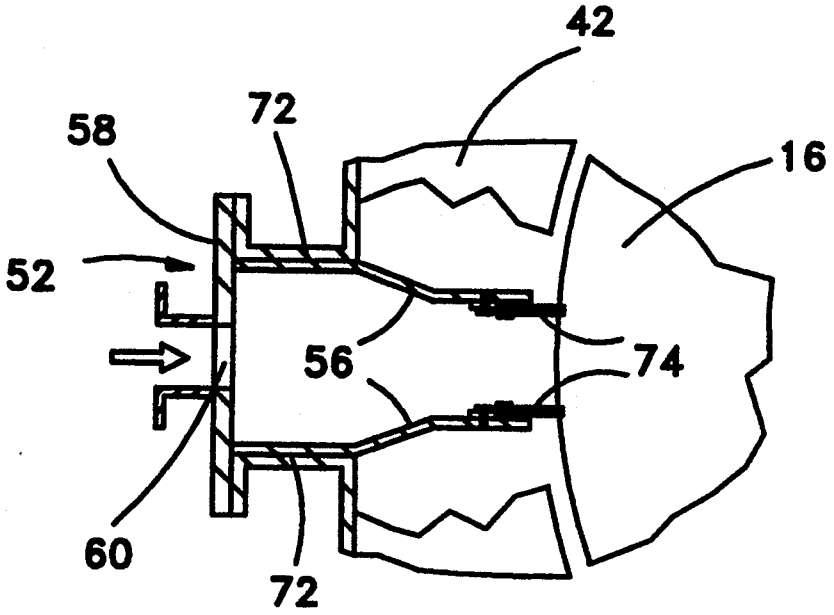
FIG. 5 is a cross-sectional, plan view of the air seal of FIG. 4.
Figure 4:
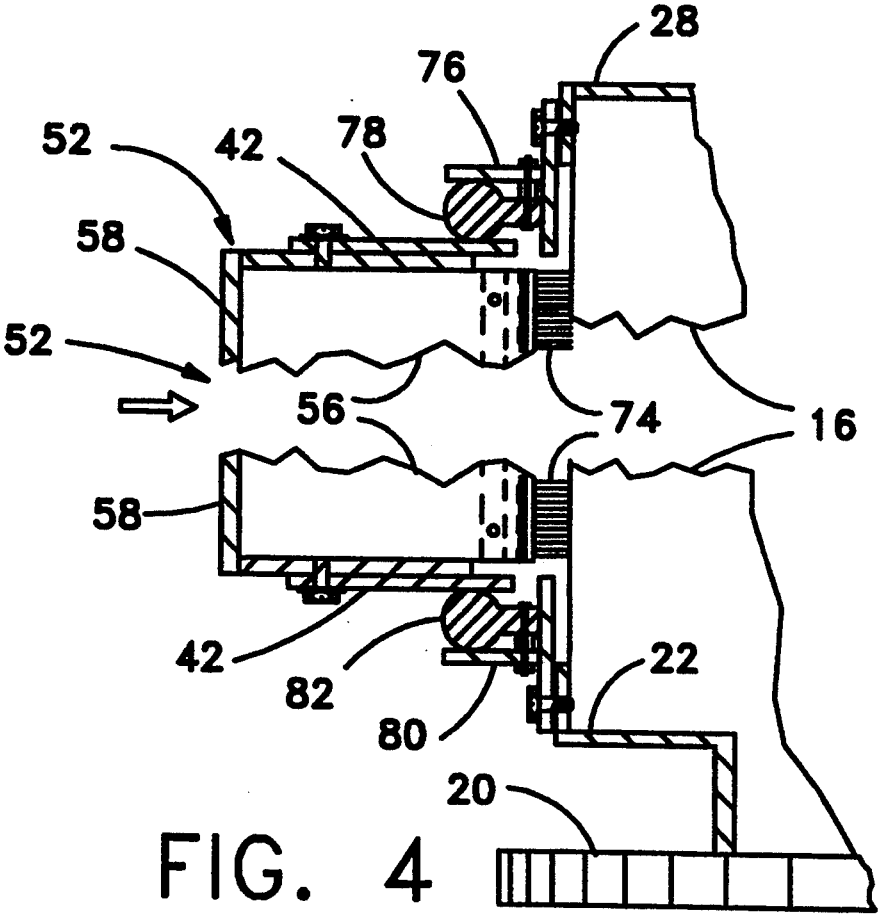
FIG. 4 is a detailed sectional view of the air seal, taken along line 4—4 of FIG. 2.

Referring to FIGS. 4–6, duct walls 56 of air seal 52 are shown mounted on vertical braces 72. The inner ends of duct walls 56 have vertically oriented wipers 74 in the form of a stainless steel brushes bolted to the inside edges of duct walls 56. Brushes 46 provide an imperfect seal between the duct walls 56 and the periphery of cage 16. Air from opening 60 can thus branch in an upstream and downstream direction, that is, clockwise and counterclockwise around cage 16.

A flange 76 is mounted to project radially outward from the steel cap of upper insulating layer 28 of cage 16. Annular seal 78 is toroidal with an inwardly directed flange bolted to the underside of flange 76. Seal 78 presses against the top of housing 42. Similarly, an outwardly projecting, radial flange 80 is secured to the steel skin of lower insulating layer 22. A toroidal seal 82, similar to seal 78, is bolted atop flange 80 in a similar fashion. Seal 82 bears on the underside of housing 42. Seals 78 and 82 prevent gas leaks from housing 42.

Referring to FIG. 7, previously mentioned burner 64 is shown as a tube with a heat deflecting shield 64A. Regulating valve 66 is shown as a thermostatically operated valve to control the heat produced by the burner. Shut off valve 84 is serially connected upstream of valve 66.

The schematic diagram of FIG. 8 shows the flow paths through cage 16. In this embodiment, a forced air blower 86 delivers contaminated gases to the upstream side of cage 16 to force the gases through the gas permeable blocks 24. Once inside central interior 30, the gases flow through the downstream side of the cage 16 through blocks 24. An induced draft is provided by previously mentioned blower 48. In this embodiment, the cleansed gas from blower 48 directly applies positive air pressure to air seals 52 on opposite sides of cage 16. In this embodiment, pressure above ambient must be applied to the air seals 52 to overcome the positive pressure forced by blower 86. It will be appreciated that some embodiments will not employ forced draft blower 86 so air seals 52 can rely on the negative pressure from induced draft blower 48.

The incoming flow of gases is schematically shown in the arrangement illustrated, to be through the heat exchange passages 24 as shown by the arrows. Because cage 16 rotates, these arrows represents flow at a given moment in time. Furthermore, as cage 16 rotates, the heat exchange media 24 no longer have sufficient heat to adequately preheat incoming gases. Accordingly, cage 16 rotates past air seals 52 to support the heat exchange.

The seals not only act as an air seal between the inlet and outlet, but also flush any dirty residual gases through the heat exchange media 24 into the combustion chamber 30. Alternatively, air seal 52 can exhaust clean air out of the combustion chamber 30.

Regardless, gas flow through the heat exchange media 24 is reversed after the cage 16 passes the nozzle of air seal 52, such that the heat exchange media 24 will now absorb heat, from the passage of clean gaseous products of combustion radially outwardly through to the outlet. By appropriate speed control of the rotation of cage 16, the preheat and recovery cycle of the heat exchange media 24 will be maintained.

Appropriate rotational speed control of cage 16 may be programmably controlled by means of a suitable control circuit, which may function in the form of a set speed or exhaust temperature control.

It is desirable to have air movement means, such as blowers 86 and 48 at both locations, in that the system can operate either with forced air at the inlet side, in which a blower or other suitable air moving means 86 can be provided, or the system can operate by means of an induced partial vacuum, in which case an air movement means, such as a blower 48 or other air movement can be used. However, in some instances it may be desirable to have air movement means, both at the inlet and outlet locations. Furthermore, the air movement means are described and illustrated as blowers only by way of example; such means may also include, for example, fans or induction devices, and indeed, even in the absence of such mechanical device, natural convection can be provided by the combustion process itself.

Figure 9:
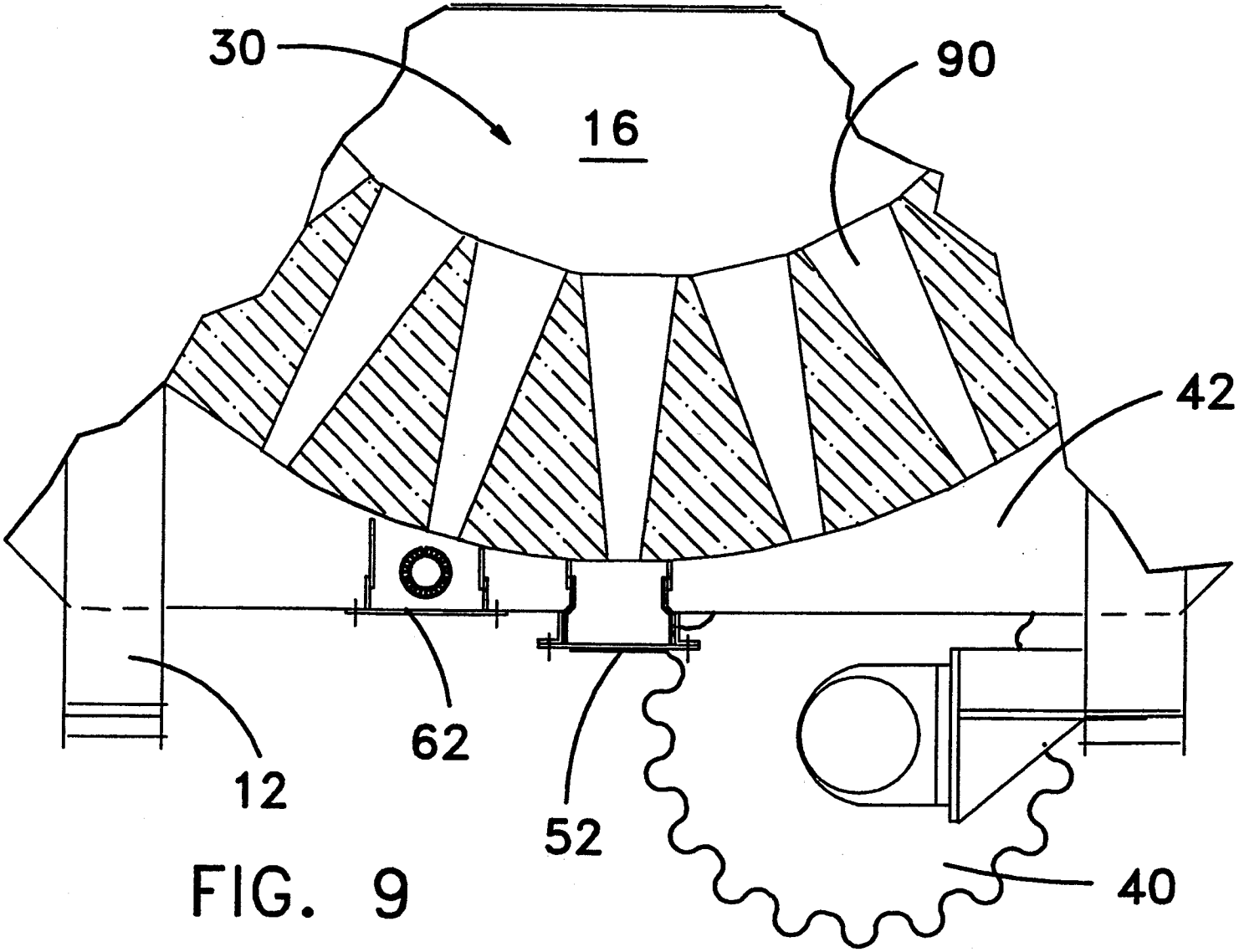
FIG. 9 is a sectional view of a fragment of the cage, which is an alternate to that illustrated in FIG. 2.

FIG. 9 is a sectional view of a portion of the device illustrated in FIG. 2. Similar components here bear the same reference numeral as before. In the embodiment of FIG. 9 gas permeable blocks 90 offer a diverging passageway to incoming gas. Blocks 90 in the upstream position have a narrower upstream cross-section than the downstream cross-section. In this embodiment, the blocks 90 are in the shape of a trapezoidal prism, although other diverging shapes can be employed instead. Since the passageway through blocks 90 diverge, incoming gas entering the block will not accelerate and will in fact decelerate to increase the residence time through the block.

As an alternate to the system shown and described herein, combustion chamber 30 and burner 32 (or an alternate electrical heating element) can be eliminated to facilitate use as a heat exchanger apparatus only, such that the inlet 44 acts as an inlet chamber for a high temperature process exhaust, and the outlet 46 acts as the outlet chamber for a preheated fresh air supply to a process. Additional chambers can replace the central combustion chamber 30 with a process outlet chamber and a clean air inlet chamber. These chambers assist in directing the process air and clean air through the heat exchange cage.

Figure 10:
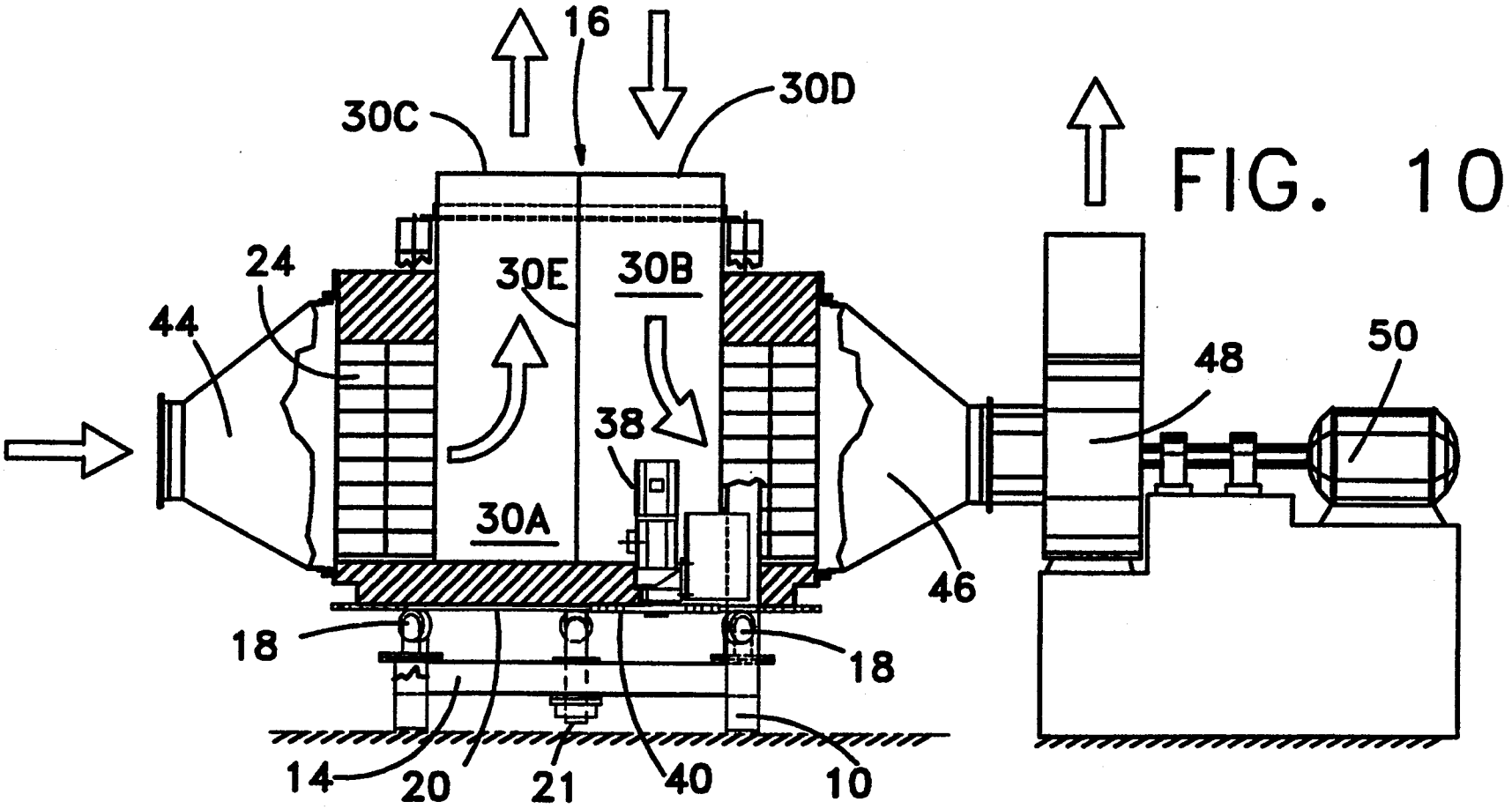
FIG. 10 is a side view of another regenerative device, also within the principles of the present invention, which is an alternate to that illustrated in FIG. 3 and in which the flow gases are routed to operate solely as a heat exchanger.

FIG. 10 illustrates such a device. This device is similar to that shown in FIG. 3, wherein components similar to that previously illustrated have the same reference numerals. In the embodiment of FIG. 10, the central interior is divided by partition 30E into two semi-cylindrical compartments 30A and 30B. Interior half 30A is shown with an interior outlet 30C while interior 30B is shown with an interior inlet 30Do The incoming flow path shown through inlet 44 and blocks 24 and into interior 30A exits from interior outlet 30C. An outgoing flow path is shown passing through interior inlet 30D to pass through interior 30D and blocks 24 to exit through outlet 46 for discharge by blower 48.

To facilitate an understanding of the principles associated with the foregoing apparatus, its operation will be briefly described. Contaminated gases may be delivered to gas inlet 44 by either a forced or induced draft. These gases can contain such volatile organic compounds that may be found in the exhaust hood of a cooking or baking process, a paint drying process, or other industrial process producing pollutants that can be thermally decomposed to reduce environmental hazards.

In accordance with the foregoing descriptions of the apparatus, contaminated fumes, odors, and V.O.C.'s that are to be burnt, enter the apparatus through inlet 44 to pass through the heat exchange passages in blocks 24 and to be preheated to temperatures very close to the incineration temperature. Gases to be treated are drawn through the gas permeable blocks 24 into central interior 30. Within interior 30, burner 32 injects a flame (although supplemental heat may be unnecessary for highly exothermic decompositions). Accordingly, volatile organic compounds such as waste solvent vapors, or fumes containing toxic substances such as benzene or formaldehyde will be decomposed. Regardless, oxidation is then completed in the combustion chamber 30 by means of autoignition of V.O.C. or by means of the gas or oil burner 32 or by an alternate electrical heating element that maintains a preset oxidation temperature.

Gases delivered into such apparatus containing V.O.C.'s may self-ignite while still in the heat exchange passages, in which event, such will facilitate and expedite the combustion in the combustion chamber. In some situations, the incoming gases may contain sufficient V.O.C.'s such that the energy released can provide all of the heat required for the apparatus and the burner 32 or other electrical heating element will shut off. After the burning is effected in the combustion chamber 30, purified gases will be discharged through the opposite heat exchange passages 24.

The temperature produced by burner 32 is regulated by a thermocouple to keep the temperature high enough to decompose the expected contaminants. The hot, cleansed gas reaches gas outlet 46 by passing through gas permeable blocks 24, thereby heating them. The blocks 24 revolve as cage 16 is turned by motor 38 whose gear 40 engages ring gear 20. Accordingly, heated blocks 24 eventually circulate to an upstream position so that incoming gas flowing through inlet 44 passes through recently heated blocks 24 to preheat the incoming gas. This preheating reduces the amount of energy required by burner 32, thereby reducing the energy demand.

In environments where the decomposition is exothermic, burner 32 may be eliminated altogether and the decomposition may proceed on its own. In either case, the exchange of heat between the outlet and inlet enhances efficiency and ensures adequate heat for decomposition.

It will be noted that the bearings/axles 21 and rollers 18 rotatably supporting cage 16 are external and are not subjected to the high temperatures within cage 16.

Furthermore, air drawn through apertures 60 in air seals 52 pass within duct walls 56 and into opening 54 (FIG. 1) of housing 42. Upon entering housing 42, the air of air seal 52 divides into an upstream and downstream branch. These two flows avoid leakage from gas inlet 44 to gas outlet 46 past cage 16.

As blocks 24 circulate, they are continually exposed to volatile organic compounds that solidify and precipitate within the narrow channels in blocks 24. Eventually, these channels in blocks 24 can clog or occlude, thereby adversely affecting system operation. To prevent such occlusion, thermal means 62 bakes blocks 24 to decomposes the deposits therein. The BTU rating of burner 64 is designed with reference to the type of deposits, the size of the blocks, and the necessary degree of cleansing.

The operation with respect to the apparatus of FIG. 8 is the same except that the forced draft caused by blower 86 produces a positive pressure inside cage 16 so that air seals 52 must work with a greater positive pressure. Blower 88 connected downstream of blower 48 supplies this positive pressure.

Also, operation with respect to the embodiment of FIG. 9 is similar except that the incoming gas traverses a diverging passage in blocks 90. Accordingly, the gas decelerates within the block 90 so that the residence time within the block is increased.

Referring to FIG. 10, the illustrated structure is arranged as a general purpose heat exchanger. The interior partition 30E prevents gas flow from inlet 44 to outlet 46. Thus, there are two isolated flow paths. Gas flowing into chamber 30B may be relatively hot and may flow through and heat gas permeable blocks 24 before exiting through outlet 46 and blower 48. As before, motor 38 rotates cage 16 so that heated blocks 24 adjacent outlet 46 are brought to an upstream position adjacent inlet 44. Consequently, the isolated gas flow through inlet 44 is heated by blocks 24 and thereby exchanges heat with the gas flow through chamber 30B. The gas from inlet 44 passing through blocks 24 flows through chamber 30A to exit through interior outlet 30C.

It is to be appreciated that various modifications may be implemented with respect to the above described preferred embodiments. The illustrated cage can be rotatably supported in various fashions with ball bearings, supporting tracks, etc. Also, the cage can be rotated by chains, ratchets, hydraulic motors, etc. In addition, the power source for rotating the cage can be from an internal combustion engine, turbine, hydraulic motor, etc. Moreover, the number, shape and size of the gas permeable blocks can be altered, depending upon the desired capacity, heat transfer, efficiency, etc. While only a pair of air seals are shown, in other embodiments a different number of seals can be used depending upon the desired integrity of the seal. While the burner that heats the interior of the cage is mounted above, in some embodiments the burner can be mounted below or in various other positions. Also, the apparatus can be constructed in any of various sizes, with the height and diameter of the cage such as will effect the desired capacity of the apparatus. Thus, the apparatus herein described, while being preferably intended to provide small, lightweight, valveless units can also provide compact and portable larger units. Also, the materials employed herein can be varied depending upon the desired strength, heat capacity, corrosion resistance, immunity to wear, thermal stability, etc. Thus, the material of construction of the various components as set forth by way of example herein, are merely examples of those that are preferred, and the same are not intended to be limiting.

Additionally, while in the system shown and described herein, the combustion chamber 30 is in the center of the heat exchanger passages, it will be understood that the combustion chamber 30 could, if desired, be located on the outside of the cage 16 in place of the inlet 44 and outlet 46. Then the new inlet and outlet would be located in the middle of the heat exchange media with entry and exit through the top, bottom or center of the cage.

Obviously, many modifications and variations of the present invention are possible in light of the above teachings. It is therefore to be understood that within the scope of the appended claims, the invention may be practiced otherwise than as specifically described.

I claim:

1. A regenerative device for thermally treating gases, comprising:

a housing having a gas inlet and a gas outlet;

a holding cage means having a central interior defining a space for rotating in said housing between said inlet and said outlet;

a plurality of gas permeable, refractory blocks mounted peripherally in said holding cage means around said central interior to provide therethrough (a) an incoming flow path from said inlet to said central interior, and (b) an outgoing flow path from said central interior to said gas outlet, said incoming flow path within each of said blocks being nonconverging;

drive means for rotating said holding cage means to move said blocks successively past said inlet and said outlet; and a dividing seal means mounted on opposite sides of said housing between said gas inlet and said gas outlet for peripherally adjoining said holding cage means and progressively traversing said blocks as said holding cage means rotates, said seal means receiving air and dividing said air into a clockwise stream and a counterclockwise stream around and in contact with said blocks.

2. A regenerative device according to claim 1 wherein said blocks have a honeycomb structure.

3. A regenerative device according to claim 1 wherein said blocks are made of ceramic.

4. A regenerative device according to claim 3 wherein said blocks have a honeycomb structure.

5. A regenerative device according to claim 1 comprising:

thermal means peripherally mounted on said housing to extend axially and to heat passing ones of said blocks and bake off residual depositions on said blocks.

6. A regenerative device according to claim 5 wherein said thermal means has a predetermined angular displacement relative to said gas inlet, said thermal means being axially sized to heat all of said blocks having said predetermined angular displacement from said gas inlet, so that all of said blocks are heated upon one revolution of said holding cage means.

7. A regenerative device according to claim 6 wherein said thermal means is located (a) nearer said gas inlet than said gas outlet, and (b) to heat blocks moving from said gas inlet to said gas outlet.

8. A regenerative device according to claim 7 wherein said blocks have a honeycomb structure.

9. A regenerative device according to claim 8 wherein said blocks are made of ceramic.

10. A regenerative device according to claim 1 comprising:

heater means for heating said central interior to enhance thermal oxidation therein of said gases.

11. A regenerative device according to claim 10 wherein said heater means is mounted on said housing coaxially with said holding cage means.

12. A regenerative device according to claim 11 wherein said heater means comprises a burner mounted over said holding cage means to inject a flame down into said central interior.

13. A regenerative device according to claim 12 wherein said blocks have a honeycomb structure.

14. A regenerative device according to claim 1 comprising:

a plurality of insulation sections interleaved with said blocks.

15. A regenerative device according to claim 12 comprising:

thermal means peripherally mounted on said housing to extend axially and to heat passing ones of said blocks and bake off residual depositions on said blocks.

16. A regenerative device according to claim 15 comprising:

an annular seal means mounted between said housing and holding cage means for preventing leakage.

17. A regenerative device according to claim 16 wherein said holding cage means comprises:

a ring gear arranged to be driven by said drive means.

18. A regenerative device according to claim 17 wherein said housing comprises:

a plurality of rollers located to subjacently support said holding cage means, said ring gear being located on a lower edge of said holding cage means to rotate azimuthally.

19. A regenerative device according to claim 1 wherein said incoming flow path within said blocks are diverging.

20. A regenerative device according to claim 1 wherein said housing has an interior outlet and an interior inlet, said incoming flow path communicating from said gas inlet through said central interior to said interior outlet, said outgoing flow path communicating from said interior inlet through said central interior to said gas outlet, said incoming flow path being isolated from said outgoing flow path.

21. A regenerative device according to claim 12 wherein said dividing seal means comprises:

an air seal means peripherally mounted on opposite sides of said housing between said gas inlet and said gas outlet to extend axially and to peripherally adjoin said holding cage means and deliver air at a pressure higher than that inside said holding cage means.

22. A regenerative device according to claim 21 comprising:

a blower coupled to said gas outlet for inducing a draft through said gas outlet and said air seal means.

23. A regenerative device for thermally treating gases, comprising:

a housing having a gas inlet and a gas outlet;

a holding cage means having a central interior for rotating in said housing between said inlet and said outlet;

a plurality of gas permeable, refractory blocks mounted peripherally in said holding cage means around said central interior to provide therethrough (a) an incoming flow path from said inlet to said central interior, and (b) an outgoing flow path from said central interior to said gas outlet;

a pair of air seal means each receiving air from a common source and each mounted on opposite sides of said housing, each between said gas inlet and said gas outlet, to extend axially and to peripherally adjoin said holding cage means and to deliver to the opposite sides of said housing air from said common source at a pressure higher than that inside said housing; and drive means for rotating said holding cage means to move said blocks successively past said inlet and said outlet.

24. A regenerative device according to claim 23 wherein said air seal means comprises:

a wiper mounted on said housing to extend axially and to peripherally engage said holding cage means.

25. A regenerative device according to claim 24 wherein said air seal means comprises:

a duct providing a passage through said housing, said wiper being mounted on said duct between said holding cage means and said duct.

26. A regenerative device according to claim 23 wherein said blocks have a honeycomb structure.

27. A regenerative device according to claim 23 wherein said blocks are made of ceramic.

28. A regenerative device according to claim 27 wherein said blocks have a honeycomb structure.

29. A regenerative device according to claim 23 comprising:

thermal means peripherally mounted on said housing to extend axially and to heat passing ones of said blocks and bake off residual depositions on said blocks.

30. A regenerative device according to claim 29 wherein said thermal means has a predetermined angular displacement relative to said gas inlet, said thermal means being axially sized to heat all of said blocks having said predetermined angular displacement from said gas inlet, so that all of said blocks are heated upon one revolution of said holding cage means.

31. A regenerative device according to claim 30 wherein said thermal means is located (a) nearer said gas inlet than said gas outlet, and (b) to heat blocks moving from said gas inlet to said gas outlet.

32. A regenerative device according to claim 23 comprising:

heater means for heating said central interior to enhance thermal oxidation therein of said gases.

33. A regenerative device according to claim 32 wherein said heater means is mounted on said housing coaxially with said holding cage means.

34. A regenerative device according to claim 33 wherein said heater means comprises a burner mounted over said holding cage means to inject a flame down into said central interior.

35. A regenerative device according to claim 32 comprising:

thermal means peripherally mounted on said housing to extend axially and to heat passing ones of said blocks and bake off residual depositions on said blocks.

36. A regenerative device according to claim 35 comprising:

an annular sealing means mounted between said housing and said holding cage means for preventing leakage.

37. A regenerative device according to claim 36 wherein said holding cage means comprises:

a ring gear arranged to be driven by said drive means.

38. A regenerative device according to claim 37 wherein said housing comprises:

a plurality of rollers located to subjacently support said holding cage means, said ring gear being located on a lower edge of said holding cage means to rotate azimuthally.

39. A regenerative device according to claim 23 wherein said incoming flow path within said blocks are diverging.

40. A regenerative device according to claim 23 wherein said housing has an interior outlet and an interior inlet, said incoming flow path communicating from said gas inlet through said central interior to said interior outlet, said outgoing flow path communicating from said interior inlet through said central interior to said gas outlet, said incoming flow path being isolated from said outgoing flow path.

41. A regenerative device for thermally treating gases, comprising:

a housing having a gas inlet and a gas outlet;

a holding cage means having a central interior for rotating in said housing between said inlet and said outlet;

a plurality of gas permeable blocks mounted peripherally in said holding cage means around said central interior to provide therethrough (a) an incoming flow path from said inlet to said central interior, and (b) an outgoing flow path from said central interior to said gas outlet;

a pair of air seals means mounted on opposite sides of said housing, each between said gas inlet and said gas outlet, to extend axially and to peripherally adjoin said holding cage means and deliver air at a pressure higher than that inside said housing, each of said air seals means having a wiper mounted on said housing to extend axially and to peripherally engage said holding cage means; and drive means for rotating said holding cage means to move said blocks successively past said inlet and said outlet.

42. A regenerative device according to claim 41 wherein each of said blocks are refractory.

* * * * *